US005586836A

United States Patent [19]

Morrow

[11] Patent Number: 5,586,836

[45] Date of Patent: Dec. 24, 1996

[54] BOOTSTRAPPING PROCESS OPTIMIZATION FOR TWO PHASE VACUUM EXTRACTION SYSTEMS

[75] Inventor: Steven R. Morrow, Hatboro, Pa.

[73] Assignee: BCM Engineers, Inc., Plymouth Meeting, Pa.

[21] Appl. No.: 241,127

[22] Filed: May 11, 1994

[51] Int. Cl.[6] ..... E03B 3/12; E21B 43/00

[52] U.S. Cl. ..... 405/128; 166/267

[58] Field of Search ..... 96/183, 184, 185, 96/186; 166/266, 267; 405/128, 129; 95/253, 254, 259; 137/115, 117

[56] References Cited

U.S. PATENT DOCUMENTS

| | | | |
|---|---|---|---|
| 4,424,068 | 1/1984 | McMillan | 96/183 X |
| 4,616,700 | 10/1986 | Wood et al. | 166/267 X |
| 4,817,711 | 4/1989 | Jeambey | 166/267 X |
| 4,890,673 | 1/1990 | Payne | 166/266 |
| 4,982,788 | 1/1991 | Donnelly | 166/267 X |
| 4,992,174 | 2/1991 | Caplan et al. | 166/267 X |
| 5,050,676 | 9/1991 | Hess et al. | 166/267 |
| 5,076,360 | 12/1991 | Morrow | 166/267 |
| 5,076,727 | 12/1991 | Johnson et al. | 405/128 |
| 5,172,764 | 12/1992 | Hajali et al. | 166/267 |
| 5,197,541 | 3/1993 | Hess et al. | 166/67 |
| 5,358,357 | 10/1994 | Mancini et al. | 405/128 |
| 5,441,365 | 8/1995 | Duffney et al. | 405/128 |

*Primary Examiner*—Dennis L. Taylor
*Assistant Examiner*—Frederick L. Lagman
*Attorney, Agent, or Firm*—Woodcock Washburn Kurtz Mackiewicz & Norris

[57] ABSTRACT

A system for receiving an effluent stream of liquids and gases from a vacuum extraction system is disclosed. The system uses the water separated from the effluent stream by a knock out pot to cool recirculating water, provide seal water and/or provide make up water to a liquid ring vacuum pump that provides the suction for vacuum extraction. In a preferred embodiment, a heat exchanger uses cool water from a knock out pot to condense vapors and uses the warm water exiting the liquid ring vacuum pump to reheat the vapor stream, raising its temperature and thus lowering its relative humidity, resulting in more efficient contaminant removal by vapor treatment systems. The knock out pot also preferably includes a free contaminant recovery system that collects and transfers liquid contaminants that separate from the water collected in the knock out pot due to a difference between the contaminant density and the density of water. The contaminants thus collect as free product either floating on top of the water or sinking to the bottom of the knock out pot.

25 Claims, 4 Drawing Sheets

BOOTSTRAPPING PROCESS OPTIMIZATION FOR TWO PHASE VACUUM EXTRACTION SYSTEMS

The present invention relates to the removal and remediation of subsurface contaminants as a mixed stream of gases and liquids, commonly referred to as two phase vacuum extraction. More specifically, the present invention relates to systems used to provide the motive power for extracting a two phase stream and transferring it from a well head to treatment equipment.

BACKGROUND OF THE INVENTION

Processes for the vacuum withdrawal of the liquid and gaseous phases of contaminants from the ground are disclosed in the prior art. These processes are known as "two phase" vacuum extraction systems and generally employ a single vacuum generating device to remove both the liquid and gaseous phase contaminants through a single well casing. The two phase stream is then separated into gaseous and liquid streams, and the separate streams are each treated to remove contaminants. A device such as a knock out pot separates the two phases of the extracted material withdrawn by the vacuum pump. After separation, effluent in the gaseous phase is conducted through appropriate treatment steps, while the liquid phase is fed to a system such as an air stripper to remove volatile organic compounds. In some instances, the air stripper is eliminated and the liquid stream is piped directly into a sump that collects the liquid for further processing, such as pumping the liquid through a granular activated carbon (GAC) contaminant removal system.

It is also known that liquid ring vacuum pumps are useful as the source of vacuum in two phase vacuum extraction systems. Liquid ring vacuum pumps have a number of advantages over other types of vacuum generators in these applications. One advantage of liquid ring vacuum pumps is their high vacuum capability, which approaches a full atmosphere of negative pressure. Consequently, liquid ring vacuum pumps can provide the maximum possible vacuum driving force to induce the required vapor-liquid flow. Secondly, liquid ring vacuum pumps have the ability to function with a two phase flow of liquid and vapor constantly flowing through them during the operation of a two phase extraction system. Therefore, slugs of liquid or other changes in the composition of the pump influent do not adversely affect pump performance. Finally, contaminant removal in liquid ring vacuum pumps is relatively easy compared to other types of high vacuum pumps which allow lubricating oil to contact the gases passing through them. The lubricating oil can be contaminated and degraded by the hydrocarbons that are extracted from soil and groundwater at the sites where two phase vacuum extraction is used for remediation. These hydrocarbons are easily dealt with when liquid ring vacuum pumps are operated with water as a sealant. The hydrocarbons are typically only slightly water soluble and can usually be removed from the water by passing it through a granular activated carbon filter. Additional advantages of liquid ring vacuum pumps are that they are operable over a wide range of flow rates and suction resistances, they are dependable due to their small number of moving parts, and they are quiet relative to other types of high vacuum machinery.

On the other hand, a disadvantage of liquid ring vacuum pumps for application at sites undergoing two phase vacuum extraction remediation has been the requirement of a constant throughput of water to maintain the liquid ring seal essential to the pump's operation and to remove the heat of compression that would otherwise result in a temperature rise that decreases pump capacity. Supplying, treating, and disposing of this sealing water or "make up" water increases the complexity and cost of two phase vacuum extraction projects. Typically, the liquid ring vacuum pump uses a supply of sealing water from a public water system. Additionally, the prior art has disclosed that the liquid effluent from the liquid ring vacuum pump discharge vapor separator may be drawn off and added to the flow in the make up water line. Such systems thus partially recycle the water from the liquid ring vacuum pump, and decrease but do not eliminate the need for make up water. However, the higher temperature of the recycled water created by the heat of compression in the liquid ring vacuum pump reduces its performance.

Thus, the requirement of a source of make up water remains a significant drawback to the use of liquid ring vacuum pumps and limits the applicability of two phase vacuum extraction systems. In a typical vacuum extraction application, a liquid ring vacuum pump needs about 5 gallons per minute in a constant flow, and much of this flow must currently be derived from a public water system.

Another disadvantage of liquid ring vacuum pumps results from the intimate mixing and heating of the extracted soil vapors and the seal water that takes place in the pump. This mixing and heating causes the vapors to attain a very high humidity, approaching or at saturation. When the vapors leave the liquid ring vacuum pump they are separated from the water in a cyclone or other vapor/liquid separating device. However, high humidity reduces the capacity of vapor phase remediation equipment such as granular activated carbon filters that is often used to remove contaminants from the discharged vapors. Calgon Corporation, a supplier of granular activated carbon, has published a chart that indicates that the capacity of granular activated carbon to adsorb tri-chloroethene (TCE, a common contaminant removed in two phase vacuum extraction processes) is four times lower at 95% relative humidity than at 50% relative humidity. The high humidity typical of soil gases extracted with ground water in a two phase stream and the increased humidity resulting from the effects of passing those gases through a liquid ring vacuum pump therefore significantly decreases efficiency and increases the costs of treating the extracted vapors when using a humidity sensitive system such as granular activated carbon. It would therefore be desirable to dehumidify the gaseous stream exiting from the liquid ring vacuum pump. However, the efficient removal of moisture usually requires a net input of energy into the system. Since the cost of energy adds to the operating costs of the system, it would be further desirable to reduce the net amount of energy required to effect moisture removal.

Accordingly, it is an object of the present invention to provide methods and apparatus for reducing the make up water requirement in two phase vacuum extraction systems that utilize liquid ring vacuum pumps. It is a further object of the present invention to provide methods and apparatus whereby the energy required to dehumidify the gaseous effluent stream is reduced. Additionally it is an object of the present invention to provide for recovering a non-aqueous phase such as gasoline or chlorinated solvent that may be extracted from the subsurface by two phase vacuum extraction.

SUMMARY OF THE INVENTION

The present invention improves on previous systems by making use of the water extracted from the ground during remediation. In one configuration, the extracted groundwater is used to reduce the temperature of the seal water in a recirculating liquid ring vacuum pump, and thereby reduces the need for service water makeup. Preferably, the extracted groundwater provides substantially all of the service water makeup required for the operation of the liquid ring vacuum pump. In certain embodiments, the present invention also includes the use of cool, extracted groundwater to condense water vapor and contaminants from the extracted vapor stream. The warmer water exiting the liquid ring vacuum pumps and/or a condenser is used to reheat the vapor stream, thereby lowering its relative humidity so that the efficiency of the vapor treatment component of a two phase vacuum extraction system is increased.

The use of the water extracted under the power of the two phase vacuum extraction system to serve its sealing, cooling and/or heating requirements as disclosed herein is called "bootstrapping." Bootstrapping provides the benefit of allowing two phase vacuum extraction operations independent of additional make up water supplies and thereby permits operation in remote locations and minimizes or eliminates the costs of purchased make up water. Reducing or eliminating the need for additional make up water also provides a major benefit by significantly reducing the volume of water throughput in the system, thereby facilitating the treatment and disposal of waste water. Moreover, achieving vapor condensation and dehumidification without relying on external energy sources contributes to ease of installation and operation at locations where such utilities are not readily available, and also reduces costs.

The recovery of non-aqueous phase liquid from a vessel under vacuum, such as a knock out pot, is also disclosed. Such recovery has heretofore not been possible. The benefits of this recovery include the recycling of the product, or at a minimum, the reduction of the costs associated with its treatment and disposal, as compared to the costs of routing the non-aqueous phase liquid through the remediation equipment. Methods and apparatus whereby the knock out pot can recover contaminants that are of a higher or lower density than water are disclosed.

DETAILED DESCRIPTION OF THE PREFERRED EMBODIMENTS

The present invention overcomes the disadvantages described above and is shown schematically in FIGS. 1A–1B, which illustrate a representative embodiment of the present invention. It will be understood, however, that the present invention is not limited to the specific arrangement illustrated.

Figure 1A:
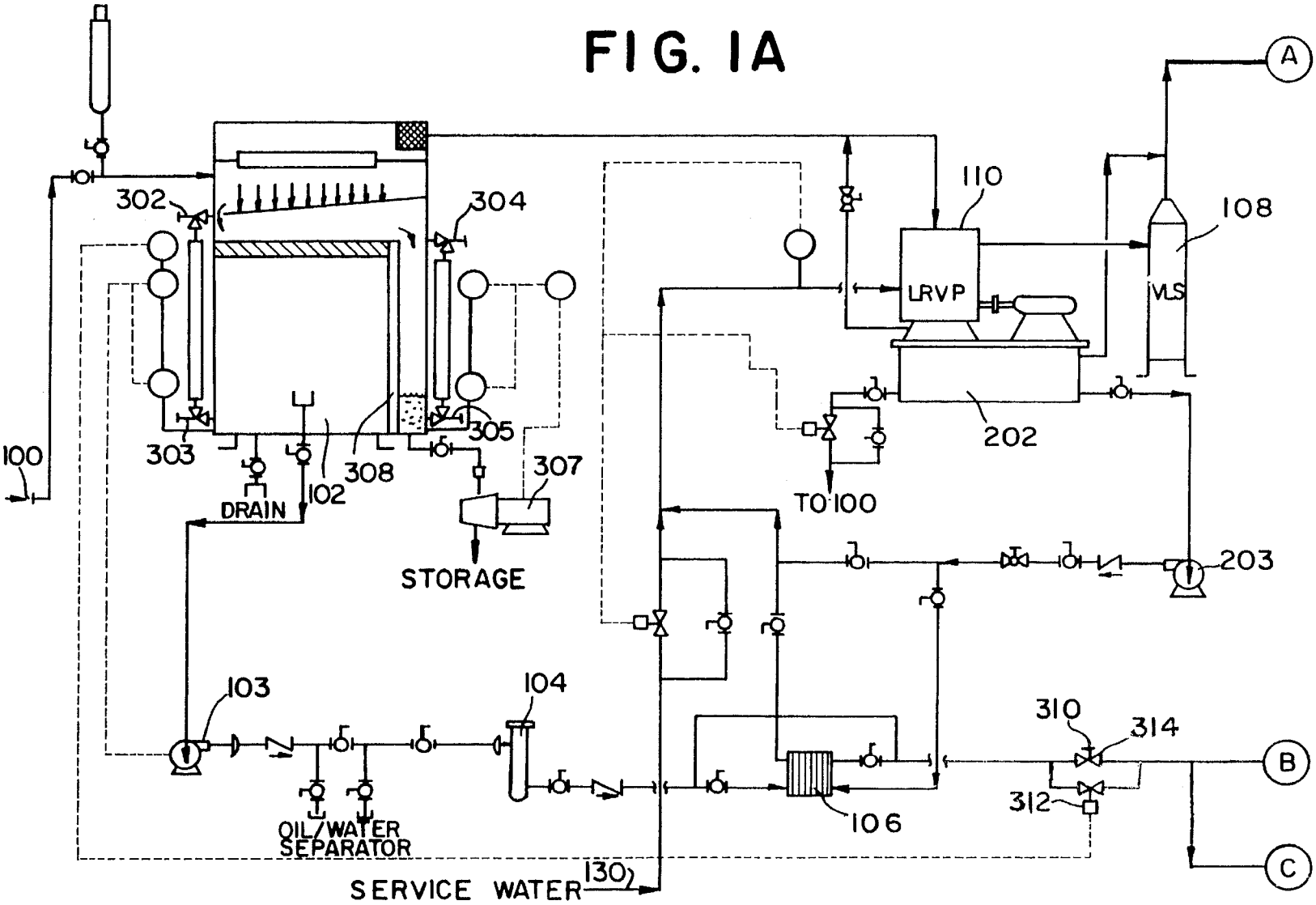
FIGS. 1A–1B are a schematic of an embodiment of the system of the present invention.
Figure 1B:
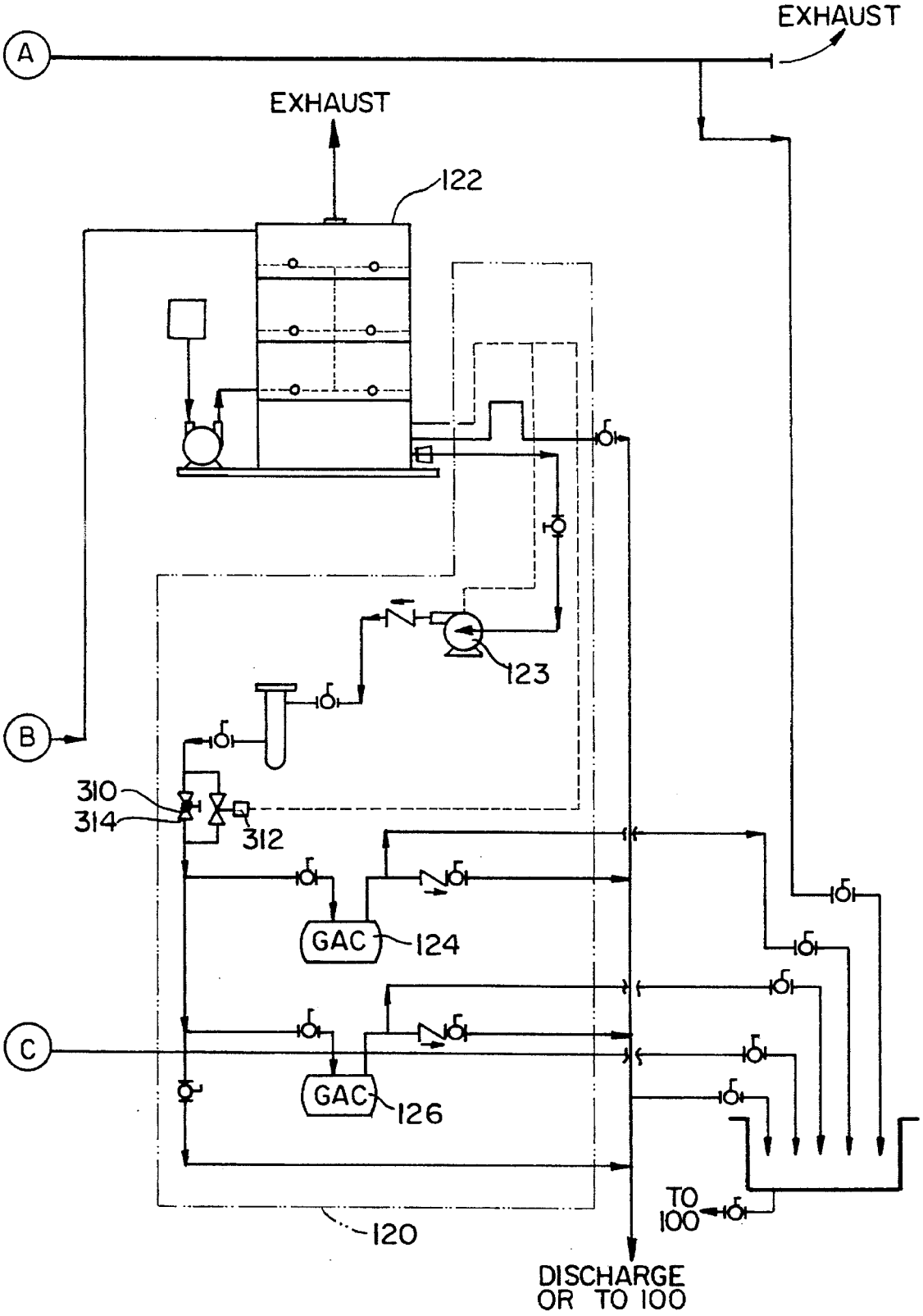

As seen in FIG. 1A, the inlet 100 of the system of the present invention is connected to a source of liquids and gases flowing in a single stream; such an influent stream is the typical result of the operation of a two phase vacuum extraction system. The two phase influent stream that enters at the inlet 100 is separated into a gaseous stream and a liquid stream by the knockout pot 102. Cool, extracted groundwater is collected in the knockout pot 102, and a pump 103 transfers this liquid to a filter 104. The pump 103 is most preferably a centrifugal pump of the type well known in the art, and the filter 104 preferably has a screen size of about 50 microns. The gaseous stream from the knockout pot 102 is drawn through the vacuum pump and then discharged into a vapor liquid separator 108, where vacuum pump seal water is removed from the gaseous stream. The liquid from the knockout pot 102 is transferred by a pump 103 through a filter 104 and into a contaminant removal system 120, shown in FIG. 1B. After filtration, the cool extracted water flows to a liquid-liquid heat exchanger 106 where the extracted water cools the warm recirculating seal water stream received from the vapor liquid separator 108. This heat exchange reduces the temperature of the recirculating seal water with the consequence that the liquid ring vacuum pump capacity is optimized. Simultaneously, the temperature of the extracted ground water is increased which facilitates the removal of contaminants in the air stripper 122, shown in FIG. 1B.

Another aspect of the present invention involves the level control of the knockout pot 102. As illustrated in FIG. 1A, an upper level switch 302 and a lower level switch 303 monitor the level of water in the knockout pot 102. The lower level switch 303 is set to permit liquid contaminants that are lighter than water, such as gasoline, to be removed from the water in the reservoir by flowing over a weir 308 while preventing water from flowing over the weir. In other words, water is allowed to accumulate in the reservoir until the upper limit switch 302 that defines the upper water level in the reservoir is tripped. Since contaminants such as gasoline are less dense and less conductive than water, the upper and lower level switches 302,303 can be float type or conductivity type, and thus can be adjusted so they are only tripped when immersed in a layer of water. The rising water causes the contaminant to spill over the weir 308 and it is then removed using a pump when switch 304 is activated, as shown. The pump 307 is most preferably a positive displacement gear pump. Although a certain amount of contaminant remains on top of the water, this residual is easily decanted, typically after remediation is complete.

Another aspect of the present invention relates to the control of the flow rate of the cool extracted water within the system. Maintaining a steady flow is particularly important in optimizing the exchange of heat in the plate heat exchanger 106. Typical trailer-mounted vacuum extraction systems do not use continuously variable valves, instead, open/close solenoid valves are used. However, these valves present a disadvantage because surges or dramatic changes in pressure and flow rate can result from their operation. Therefore, in preferred embodiments of the present invention, the flow of the system is controlled by a double valve system 310 that substantially eliminates surges without requiring the expense and complexity of continuously variable active valves. The double valve system 310 is seen in both FIG. 1A and FIG. 1B and preferably comprises a solenoid valve 312 and a throttling valve 314 that is hand set to an initial flow. The throttling valve 314 controls the flow from the vessel, and is set so that the flow is equal to the flow into the vessel. Any difference between the flow in and the flow out of the vessel is accounted for by opening the solenoid valve 312 to increase the outflow, or by stopping the pump 103,123 to decrease.

Figure 2A:
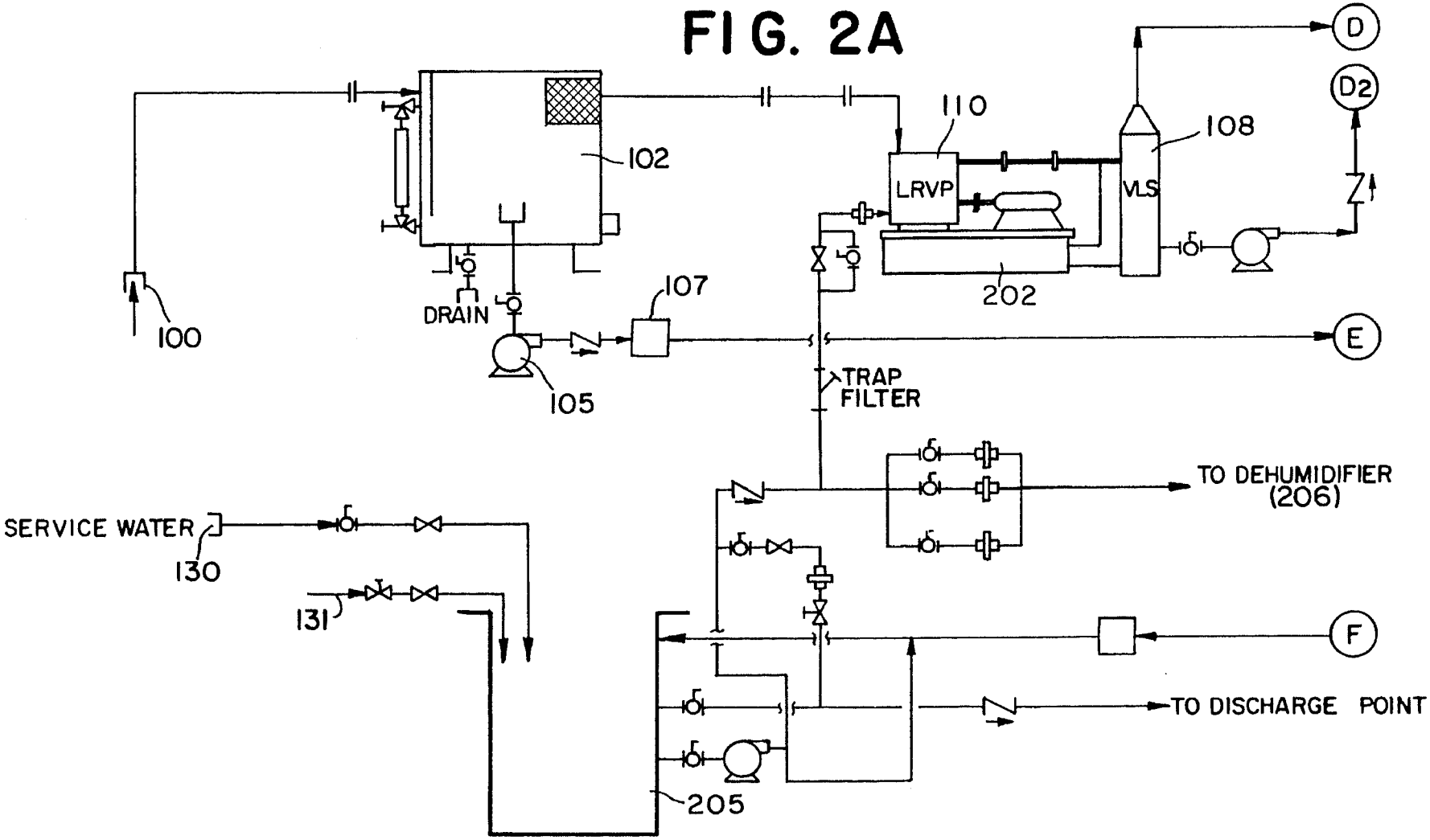
FIGS. 2A–2B are a schematic of another embodiment of the system of the present invention.
Figure 2B:
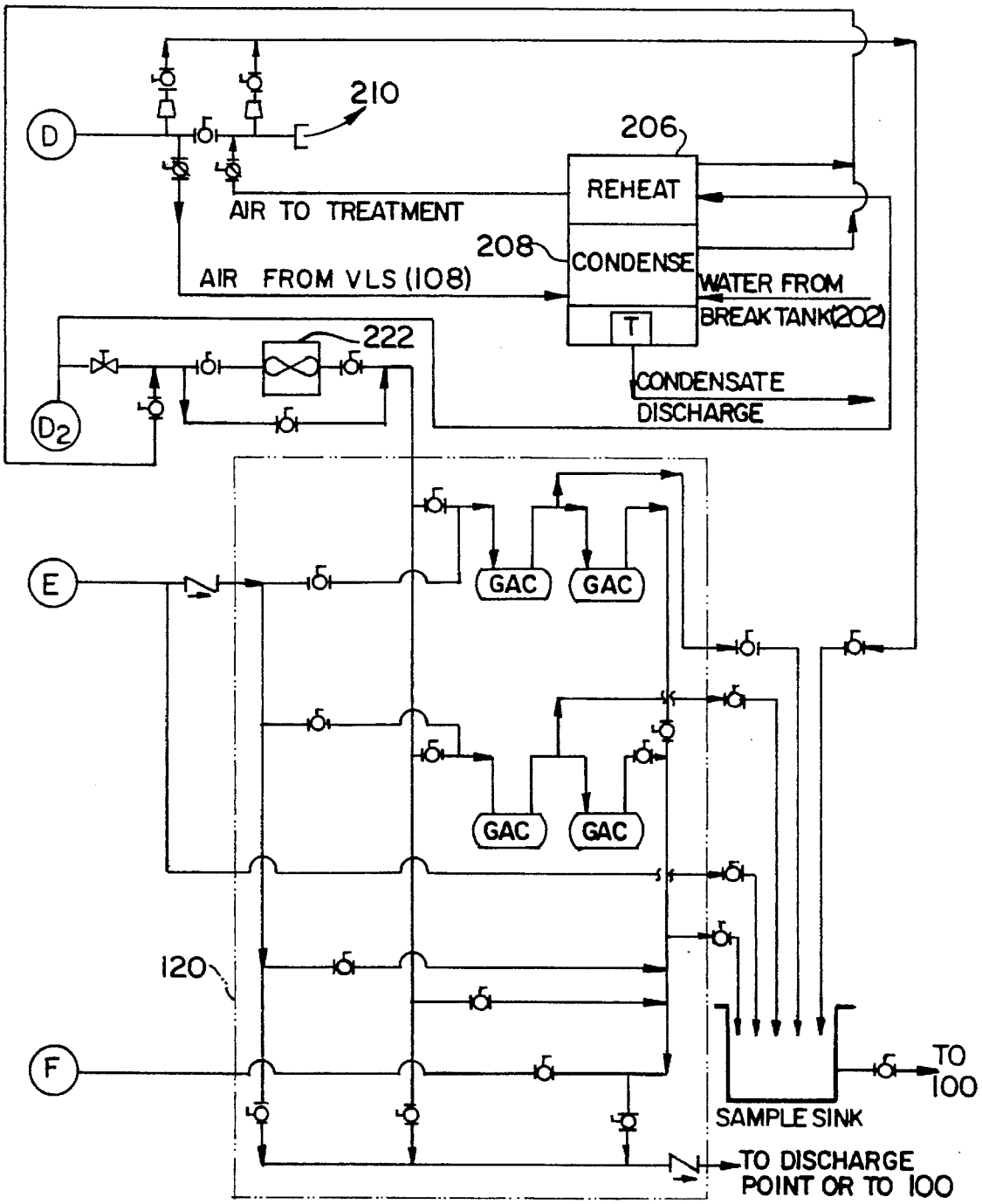

Referring now to FIGS. 2A–2B, another embodiment of the present invention is disclosed. In this embodiment, cool water from the knock out pot 102 is used to condense vapors from the air stream. To further reduce its relative humidity the air stream is subsequently reheated using warm water from the liquid ring vacuum pump discharge. Thus, as seen in FIG. 2A, a two phase influent stream enters at the inlet 100 and is separated into a gaseous stream and a liquid stream by the knock out pot 102. The gaseous stream is drawn through the vacuum pump and discharged into the vapor liquid separator 108, where seal water is removed from the gaseous stream, as explained above with reference to FIG. 1A. The liquid from the knock out pot 102 is transferred by a pump 105 through a filter 107 and into a contaminant removal system 120, shown in FIG. 2B and explained above with reference to FIG. 1B. The water from the contaminant removal system 120 then flows to a break tank 205, shown in FIG. 2A, which can also receive water from a service water source 130, as explained above. Additionally, water from a well may be supplied by a well water line 131. These various sources of cool water are supplied to the break tank 205 as needed, and as explained above, the liquid level in the break tank is monitored and controlled.

From the break tank 205, a portion of the cool water flows to a vapor dehumidifier cooling section 208 seen in FIG. 2B, however, as seen in FIG. 2A, a portion of the water is routed to the liquid ring vacuum pump 110 to provide seal water. Alternatively, the flow may be discharged in a discharge line 210. In the dehumidifier condensing section 208 the water cools the warm vapor stream received from the vapor liquid separator 108. The water stream from the dehumidifier condensing section 208 is combined with the water stream from the dehumidifier reheat section 206. The combined stream is routed through an air cooled heat exchanger 222 and treated in the granular activated carbon filter system 120. The water is then returned to the break tank 205. The air cooled heat exchanger 222 further reduces the temperature of the recirculating water stream, so that it provides cool seal water for the liquid ring vacuum pump 110. Alternatively, the air cooled heat exchanger 222 is used to directly reduce the temperature of the water discharge of the liquid ring vacuum pump 110.

Thus, any water treated in the granular activated carbon system 120 may then be discharged or, more preferably, is routed to a break tank 205 that serves as a reservoir and allows control of the water balance in the system. From the break tank 205, seal water is either drawn out under vacuum, or is pumped on flow control to the liquid ring vacuum pump 110. Excess water produced from the two phase vacuum extraction process is overflowed or pumped to another part of the system for further treatment or disposal. If only a small amount of water is present in the two phase influent stream 100, and there is a net loss of water from the system loop, make up water from an external service line 130 or well line 131 can be added to the break tank 205. Any makeup water from a potable source is added from above the maximum liquid level in the break tank 205 so that there can be no backflow of potentially contaminated water into the supply connected to the service water line 130. An irreversible hydraulic break is provided, hence the name of the vessel.

Thus, as disclosed and described above, the present invention provides improved methods of removing contaminants from a contaminated site by applying a vacuum from a liquid ring vacuum pump to withdraw a two phase stream into a conduit. The two phase stream is then discharged into a knock out pot to create a liquid stream and a gaseous stream. With respect to the liquid stream, at least a portion of the non-aqueous phase liquid contaminants are separated in the knockout pot due to the difference in density between the contaminants and the water. Remaining contaminants in the liquid stream are treated in accordance with approved techniques. The vapor stream also may contain contaminants and is similarly treated to effect their removal. Contaminants are thus removed from the site as free phase product that separates from the collected groundwater while within the knockout pot, as liquid contaminants removed from the extracted groundwater by filtration or other treatment, and as gaseous contaminants removed from the extracted vapor stream by filtration or other treatment.

In one embodiment where the contaminant has a lower density than water, the method of the present invention preferably includes removing contaminants floating on the water by flowing the contaminants over a weir, sensing an upper water level in the reservoir, shutting off the flow of liquid to the reservoir, and reducing the water level in the reservoir to permit additional inflow. In another embodiment, the system is modified to achieve the same result where the contaminant has a higher density than water and collects at the bottom of the reservoir section. In such an embodiment, the dense contaminant level would rise, forcing water over the weir until a limit switch is tripped, activating a pump (with an inlet located at the bottom of the reservoir) that removes the contaminant. Thus, the disclosed system takes advantage of the relative density difference between the contaminant and the water, and either flows contaminant over the top of the weir or determines when contaminant level within the reservoir is sufficient to permit it to be conveniently drained from the bottom of the reservoir.

The invention improves upon known systems by supplying a source of make up water to the liquid ring vacuum pump that is comprised of at least a portion of the liquid stream collected by the knock out pot. The invention also uses the cool water from the knock out pot to condense vapors from the gaseous discharge stream. The seal water from the liquid ring vacuum pump creates a heated discharge stream, and the present invention provides an additional improvement by supplying at least a portion of this heated discharge stream to a dehumidifier connected to the gaseous stream, whereby the relative humidity of the gaseous stream is reduced prior to the step of removing contaminants from the gaseous stream, which as noted above increases the efficiency of contaminant removal.

Although certain embodiments of the present invention have been illustrated above and described with particularity, these embodiments are provided for purposes of illustration and are not meant to limit the present invention. Upon review of the foregoing specification and drawings, those of ordinary skill will immediately realize numerous adaptations and modifications of the disclosed system. These additional embodiments, however, will be within the spirit of the present invention. Therefore, in order to ascertain the scope of the present invention, attention is directed to the appended claims.

What is claimed is:

1. A system for receiving a two phase stream of liquids and gases drawn by a vacuum extraction system comprising:

a knock out pot for separating the liquids and gases;

a vacuum line connecting the knock out pot to a vacuum pump; and a knock out pot pump connected to the knockout pot for removing liquid from the knockout pot, whereby a quantity of cooling liquid is supplied by liquid collected in the knockout pot.

2. The system of claim 1, wherein the vacuum pump is a liquid ring vacuum pump and the knock out pot comprises a discharge stream that supplies make up water to the liquid ring vacuum pump.

3. The system of claim 2, further comprising a break tank connected to the discharge stream.

4. The system of claim 2 wherein the liquid ring vacuum pump is connected to a two phase discharge conduit, and the system further comprises a vapor liquid separator connected to the conduit for removing seal water discharged by the liquid ring vacuum pump.

5. The system of claim 4, wherein the vapor liquid separator comprises a liquid outlet stream, and the liquid outlet stream is provided to a heat exchanger.

6. The system of claim 5, wherein a stream of cool liquid from the knock out pot is supplied to the heat exchanger.

7. The system of claim 1 further comprising a make up pump and a filter connected to a water line.

8. The system of claim 1, wherein the knock out pot comprises a water reservoir section and a contaminant reservoir section separated by a weir and having an upper edge and upper and lower limit switches for controlling the liquid level in one of the reservoir sections.

9. The system of claim 1, further comprising a break tank for retaining a supply of water, the break tank comprising a break tank outlet stream connected to one or more of a dehumidifier, the liquid ring vacuum pump, and a discharge stream.

10. The system of claim 9, wherein the break tank comprises a break tank outlet stream connected to a dehumidifier and a liquid ring vacuum pump.

11. The system of claim 9, wherein the break tank outlet stream flows through a heat exchanger to condense liquids from a vapor stream and a water line from the vapor liquid separator flows through a heat exchanger to reheat a vapor stream, thereby lowering its relative humidity.

12. The system of claim 1, wherein the knock out pot comprises:

a water reservoir section;

a contaminant reservoir section separated from the a water reservoir section by a weir; and upper and lower limit switches for controlling the liquid level in the reservoir sections.

13. The system of claim 12, wherein the liquid within the knock out pot comprises a layer of liquid contaminant floating on top of a water layer, and the upper and lower limit switches are activated by the water layer, whereby the liquid contaminant will overflow the weir before the upper limit switch is activated by the water layer.

14. The system of claim 13 further comprising a free product recovery system for collecting contaminant that has overflowed the weir and a contaminant pump for transferring the contaminant to storage.

15. The system of claim 1, further comprising an air stripper connected to a water line for removing contaminants from the withdrawn stream of liquid.

16. The system of claim 1 further comprising one or more granular activated carbon contaminant removal systems connected to the water line.

17. The system of claim 1, further comprising a double valve system connected to a water line for providing a substantially constant flow in the water line, the valve system comprising a solenoid valve and a throttling valve.

18. A system for receiving a two phase stream of liquids and gases drawn by a vacuum extraction system comprising:

a knock out pot for separating the liquids and gases that comprises a discharge stream that supplies make up water to a liquid ring vacuum pump connected to a two phase discharge conduit;

a vacuum line connecting the knock out pot to the liquid ring vacuum pump;

a pump connected to the knockout pot for removing liquid from the knockout pot; and a vapor liquid separator connected to the conduit for removing seal water discharged by the liquid ring vacuum pump, wherein the vapor liquid separator comprises a liquid outlet stream, and the liquid outlet stream is provided to reheat an exhaust air stream collected from a dehumidifier condensing section, whereby a quantity of cooling liquid is supplied by liquid collected in the knockout pot.

19. A groundwater treatment system comprising a double valve system connected to a water line for providing a substantially constant flow in the water line, the valve system comprising a solenoid valve and a throttling valve.

20. A method of removing contaminants from a contaminated site comprising the steps of:

applying a vacuum from a liquid ring vacuum pump to withdraw a two phase stream into a conduit;

discharging the two phase stream into a knock out pot to create a liquid stream and a gaseous stream;

removing contaminants from the gaseous stream;

supplying a source of make up water to the vacuum pump that is comprised of at least a portion of the liquid stream wherein the step of supplying make up water to the liquid ring vacuum pump creates a heated discharge stream, the method comprising the additional step of supplying at least a portion of the heated discharge stream to a dehumidifier connected to the gaseous stream, whereby the relative humidity of the gaseous stream is reduced prior to the step of removing contaminants from the gaseous stream; and removing contaminants from the liquid stream.

21. The method of claim 20, further comprising the steps of removing contaminants floating on the water in the knock out pot by flowing the contaminants over a weir until the water reaches the upper level sensor; and reducing the water level in the knock out pot.

22. The method of claim 21 further comprising the steps of flowing of cool water from the knock out pot to a heat exchanger and flowing warm water from a vapor liquid separator to the heat exchanger, whereby the temperature of the warm water is reduced.

23. In a remediation system wherein a vacuum pump withdraws a stream of contaminants and water, the improvement comprising a knock out pot for removing the contaminants from the water, comprising:

a water reservoir section and a contaminant reservoir section separated by a weir and having an upper edge; and upper and lower limit switches for controlling a liquid level in the reservoir section, wherein one of either the water or contaminant reservoir section contains a layer of liquid contaminant and a water layer, and the upper and lower limit switches are activated by one of the layers, whereby liquid contaminant is removed by operation of one of the limit switches being activated.

24. The knock out pot of claim 23 further comprising a free product recovery system for collecting contaminant that has overflowed the weir and a contaminant pump for transferring the contaminant.

25. The knock out pot of claim 23 further comprising a water recovery system for collecting water that has overflowed the weir, a water pump for transferring water to treatment and disposal, and a contaminant pump for transferring the contaminant.

* * * * *